US006789603B2

(12) United States Patent
Kono

(10) Patent No.: US 6,789,603 B2
(45) Date of Patent: Sep. 14, 2004

(54) INJECTION MOLDING METHOD AND APPARATUS WITH BASE MOUNTED FEEDER

(75) Inventor: Kaname Kono, Tokyo (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 10/768,022

(22) Filed: Feb. 2, 2004

(65) Prior Publication Data

US 2004/0149419 A1 Aug. 5, 2004

Related U.S. Application Data

(62) Division of application No. 10/135,396, filed on May 1, 2002, now Pat. No. 6,742,570.

(51) Int. Cl.[7] ..... B22D 17/08; B22D 25/00

(52) U.S. Cl. ..... 164/113; 164/312; 164/900

(58) Field of Search ..... 164/113, 312, 164/900

(56) References Cited

U.S. PATENT DOCUMENTS

| | | | |
|---|---|---|---|
| 2,386,966 | A | 10/1945 | MacMillin |
| 2,505,540 | A | 4/1950 | Goldhard |
| 2,529,146 | A | 11/1950 | Feitl |
| 2,785,448 | A | 3/1957 | Hodler |
| 3,048,892 | A | 8/1962 | Davis, Jr. et al. |
| 3,106,002 | A | 10/1963 | Bauer |
| 3,123,845 | A | 3/1964 | Madwed |
| 3,172,174 | A | 3/1965 | Johnson |

(List continued on next page.)

FOREIGN PATENT DOCUMENTS

| | | |
|---|---|---|
| DE | 37 44 296 | 7/1989 |
| DE | 196 11 419 | 9/1996 |
| EP | 0 476 843 | 3/1992 |
| EP | 0 761 344 | 3/1997 |
| FR | 1.447.606 | 11/1996 |
| JP | 59-152826 | 8/1984 |
| JP | 1-166874 | 6/1989 |
| JP | 1-178345 | 7/1989 |

(List continued on next page.)

OTHER PUBLICATIONS

Mehrabian et al., "Casting in the Liquid–Solid Region," *New Trends in Materials Processing*, papers presented at a seminar of American Society for Metals, Oct. 19 and 20, 1974, ASM, Metals Park, OH, pp. 98–127.

Flemings et al., "Rheocasting," *Challenges and Opportunities in Materials Science and Engineering* (Anniversary Volume), vol. 25 (1976), Elsevier Sequoia S.A., Lausanne, pp. 103–117.

Flemings et al., "Rheocasting," *McGraw–Hill Yearbook of Science and Technology, 1977*, McGraw–Hill Book Company, NY, pp. 49–58.

Laxmanan et al., "Deformation of Semi–Solid Sn–15 Pct. Pb Alloy," *Metallurgical Transactions A*, vol. 11A: No. 12, Dec. 1980, pp. 1927–1937.

Matsumiya et al., "Modeling of Continuous Strip Production by Rheocasting," *Metallurgical Transactions B*, vol. 12B, No. 1, Mar. 1981, pp 17–31.

Suery et al., "Effect of Strain Rate on Deformation Behavior of Semi–Solid Dendritic Alloys," *Metallurgical Transactions A*, vol. 13A, No. 10: Oct., 1982, pp. 1809–1819.

(List continued on next page.)

*Primary Examiner*—Kuang Y. Lin
(74) *Attorney, Agent, or Firm*—Foley & Lardner LLP

(57) ABSTRACT

An injection molding apparatus contains two chambers and a melt feeder. The melt feeder is mounted to the machine base. The liquid metal in the melt feeder is maintained below the level of an opening to a driving mechanism attached to an upper of the two chambers.

6 Claims, 3 Drawing Sheets

U.S. PATENT DOCUMENTS

| | | | |
|---|---|---|---|
| 3,189,945 | A | 6/1965 | Strauss |
| 3,201,836 | A | 8/1965 | Nyselius |
| 3,254,377 | A | 6/1966 | Morton |
| 3,268,960 | A | 8/1966 | Morton |
| 3,270,378 | A | 9/1966 | Madwed |
| 3,270,383 | A | 9/1966 | Hall et al. |
| 3,286,960 | A | 11/1966 | Douglas et al. |
| 3,319,702 | A | 5/1967 | Hartwig et al. |
| 3,344,848 | A | 10/1967 | Hall et al. |
| 3,447,593 | A | 6/1969 | Nyselius et al. |
| 3,474,854 | A | 10/1969 | Mace |
| 3,491,827 | A | 1/1970 | Mace |
| 3,529,814 | A | 9/1970 | Werner |
| 3,550,207 | A | 12/1970 | Struss |
| 3,693,702 | A | 9/1972 | Piekenbrink et al. |
| 3,773,873 | A | 11/1973 | Spaak et al. |
| 3,810,505 | A | 5/1974 | Cross |
| 3,814,170 | A | 6/1974 | Kahn |
| 3,874,207 | A | 4/1975 | Lemelson |
| 3,893,792 | A | 7/1975 | Laczko |
| 3,902,544 | A | 9/1975 | Flemings et al. |
| 3,936,298 | A | 2/1976 | Mehrabian et al. |
| 3,976,118 | A | 8/1976 | Kahn |
| 4,049,040 | A | 9/1977 | Lynch |
| 4,088,178 | A | 5/1978 | Ueno et al. |
| 4,168,789 | A | 9/1979 | Deshais et al. |
| 4,212,625 | A | 7/1980 | Shutt |
| 4,287,935 | A | 9/1981 | Ueno et al. |
| 4,330,026 | A | 5/1982 | Fink |
| 4,347,889 | A | 9/1982 | Komatsu et al. |
| 4,387,834 | A | 6/1983 | Bishop |
| 4,434,839 | A | 3/1984 | Vogel |
| 4,436,140 | A | 3/1984 | Ebisawa et al. |
| 4,473,103 | A | 9/1984 | Kenney et al. |
| 4,476,912 | A | 10/1984 | Harvill |
| 4,510,987 | A | 4/1985 | Collot |
| 4,534,403 | A | 8/1985 | Harvill |
| 4,537,242 | A | 8/1985 | Pryor et al. |
| 4,559,991 | A | 12/1985 | Motomura et al. |
| 4,586,560 | A | 5/1986 | Ikeya et al. |
| 4,635,706 | A | 1/1987 | Behrens |
| 4,687,042 | A | 8/1987 | Young |
| 4,694,881 | A | 9/1987 | Busk |
| 4,694,882 | A | 9/1987 | Busk |
| 4,730,658 | A | 3/1988 | Nakano |
| 4,771,818 | A | 9/1988 | Kenney |
| 4,828,460 | A | 5/1989 | Saito et al. |
| 4,834,166 | A | 5/1989 | Nakano |
| 4,884,621 | A | 12/1989 | Ban et al. |
| 4,898,714 | A | 2/1990 | Urban et al. |
| 4,952,364 | A | 8/1990 | Matsuda et al. |
| 4,997,027 | A | 3/1991 | Akimoto |
| 5,040,589 | A | 8/1991 | Bradley et al. |
| 5,109,914 | A | 5/1992 | Kidd et al. |
| 5,143,141 | A | 9/1992 | Frulla |
| 5,144,998 | A | 9/1992 | Hirai et al. |
| 5,161,598 | A | 11/1992 | Iwamoto et al. |
| 5,181,551 | A | 1/1993 | Kidd et al. |
| 5,186,236 | A | 2/1993 | Gabathuler et al. |
| 5,191,929 | A | 3/1993 | Kubota et al. |
| 5,205,338 | A | 4/1993 | Shimmell |
| 5,244,033 | A | 9/1993 | Ueno |
| 5,375,645 | A | 12/1994 | Brueker et al. |
| 5,380,187 | A | 1/1995 | Fujikawa |
| 5,388,633 | A | 2/1995 | Mercer, II et al. |
| 5,394,931 | A | 3/1995 | Shiina et al. |
| 5,413,644 | A | 5/1995 | Marder et al. |
| 5,501,266 | A | 3/1996 | Wang et al. |
| 5,531,261 | A | 7/1996 | Yoshida et al. |
| 5,533,562 | A | 7/1996 | Moschini et al. |
| 5,571,346 | A | 11/1996 | Bergsma |
| 5,575,325 | A | 11/1996 | Sugiura et al. |
| 5,577,546 | A | 11/1996 | Kjar et al. |
| 5,601,136 | A | 2/1997 | Shimmell |
| 5,622,216 | A | 4/1997 | Brown |
| 5,623,984 | A | 4/1997 | Nozaki et al. |
| 5,630,463 | A | 5/1997 | Shimmell |
| 5,630,466 | A | 5/1997 | Garat et al. |
| 5,638,889 | A | 6/1997 | Sugiura et al. |
| 5,657,812 | A | 8/1997 | Walter et al. |
| 5,662,159 | A | 9/1997 | Iwamoto et al. |
| 5,664,618 | A | 9/1997 | Kai et al. |
| 5,665,302 | A | 9/1997 | Benni et al. |
| 5,680,894 | A | 10/1997 | Kilbert |
| 5,685,357 | A | 11/1997 | Kato et al. |
| 5,697,422 | A | 12/1997 | Righi et al. |
| 5,697,425 | A | 12/1997 | Nanba et al. |
| 5,701,942 | A | 12/1997 | Adachi et al. |
| 5,704,411 | A | 1/1998 | Suzuki et al. |
| 5,716,467 | A | 2/1998 | Marder et al. |
| 5,730,198 | A | 3/1998 | Sircar |
| 5,730,202 | A | 3/1998 | Shimmell |
| 5,735,333 | A | 4/1998 | Nagawa |
| 5,770,245 | A | 6/1998 | Takizawa et al. |
| 5,836,372 | A | 11/1998 | Kono |
| 5,839,497 | A | 11/1998 | Fujino et al. |
| 5,861,182 | A | 1/1999 | Takizawa et al. |
| 5,913,353 | A | 6/1999 | Riley et al. |
| 5,983,976 | A | 11/1999 | Kono |
| 6,065,526 | A | 5/2000 | Kono |
| 6,135,196 | A | 10/2000 | Kono |
| 6,241,001 | B1 | 6/2001 | Kono |
| 6,276,434 | B1 | 8/2001 | Kono |
| 6,283,197 | B1 | 9/2001 | Kono |
| 6,284,167 | B1 | 9/2001 | Fujikawa |
| 2001/0052405 | A1 * | 12/2001 | Takizawa et al. ..... 164/113 |

FOREIGN PATENT DOCUMENTS

| | | |
|---|---|---|
| JP | 1-192447 | 8/1989 |
| JP | 2-202420 | 8/1990 |
| JP | 5-8016 | 1/1993 |
| JP | 5-8017 | 1/1993 |
| JP | 2-274360 | 1/1993 |
| JP | 5-285626 | 11/1993 |
| JP | 5-285627 | 11/1993 |
| JP | 6-306507 | 11/1994 |
| JP | 7-51827 | 2/1995 |
| JP | 8-72110 | 3/1996 |
| JP | 8-174172 | 7/1996 |
| JP | 8-252661 | 10/1996 |
| JP | 9-103859 | 4/1997 |
| JP | 9-155524 | 6/1997 |
| JP | 9-155526 | 6/1997 |
| JP | 9-155527 | 6/1997 |
| JP | 9-295122 | 11/1997 |
| TW | 153528 | 3/1991 |
| WO | WO 92/13662 | 8/1992 |
| WO | WO 97/21509 | 6/1997 |
| WO | WO 97/45218 | 12/1997 |
| WO | WO 99/28065 | 6/1999 |
| WO | WO 99/50007 | 10/1999 |

OTHER PUBLICATIONS

Worthy, Ward, "Injection Molding of Magnesium Alloys," *Chemical & Engineering News*, vol. 66, No. 23, Jun. 6, 1988, pp. 29–30.

Tissier et al., "Magnesium rheocasting: a study of processing–microstructure interactions," *Journal of Materials Science*, vol. 25 (1990). Chapman and Hall Ltd., pp 1184–1196.

Carnahan et al., "New Manufacturing Process for Metal Matrix Composite Synthesis," *Fabrication of Particulates Reinforced Metal Composites*, Proceedings of an International Conference, Montreal, Quebec, Sep. 17–29, 1990, ASM International, Metals Park, Ohio, pp 101–105.

Flemings, "Behavior of Metal Alloys in the Semisolid State," *Metallurgical Transactions B*, vol. 22B, No. 3, Jun. 1991, pp. 269–293.

Pasternak et al., "Semi–Solid Production Processing of Magnesium Alloys by Thixomolding," Proceedings of the Second International Conference on the Semi–Solid Processing of Alloys and Composites, MIT, Cambridge, MA, Jun. 10–12, 1992, TMS, Warrendale, PA, pp. 159–169.

Brown et al., "Net Shape Forming via Semi–Solid Processing," *Advanced Materials & Processes*, vol. 143, No. 1, Jan. 1993, ASM International, Metals Park, OH, pp 36–40.

Carnanan et al., "Advances in Thixomolding," 52$^{nd}$ Annual World Magnesium Conference, Berlin, Germany, May 17–19, 1994.

Fujikawa, Misao, Conference Material, Sodick Plastech Co., Ltd., Jul. 1995, pp 1–14.

Staff Report, "Semi–Solid Metalcasting Gains Acceptance, Applications," *Foundry Management & Technology*, Nov. 1995, Japan, pp. 23–26.

Tuparl Injection Molding Machine Advertisement, Sodick Plastech Co., Ltd., May 1997.

Kalpakjian, Serope, *Manufacturing Processes for Engineering Materials*, 3rd edition, Addison Wesley Longman, Inc., Menlo Park, CA, 1997, pp. 261–263, 265–266.

"Plastic Processing Technology Book," Published in Japan (ISBN 4–526–00035–3).

Material Science & Technology Textbook, Fig. 1–67(b), p 52.

* cited by examiner

INJECTION MOLDING METHOD AND APPARATUS WITH BASE MOUNTED FEEDER

FIELD OF THE INVENTION

The invention generally relates to a method and apparatus for manufacturing metallic parts, and more particularly to a method and apparatus for manufacturing metallic parts by a process involving injection of a melted metal into a mold.

BACKGROUND OF THE INVENTION

One method used to produce molded metallic parts from melted metal is by die casting. One die casting system and method are described in U.S. Pat. No. 5,983,976, hereby incorporated by reference. Die casting methods inject liquid metal into a mold.

Semi-solid methods for producing molded metallic parts differ from the die casting methods by injection molding a metal in its semi-solid state rather than in its liquid state. Semi-solid injection molding systems and methods are disclosed in U.S. Pat. Nos. 5,836,372 and 6,135,196, both of which are incorporated by reference herein.

The die casting system described in U.S. Pat. No. 5,983,976 is illustrated in FIG. 1. The system 10 includes an injection molding apparatus 10 and a mold 14. Apparatus 10 is preferably mounted on wheels and/or rails (not shown) such that it may be retracted from the mold 14 after each injection step and advanced toward the mold 14 before each injection step by a motor or hydraulics (not shown).

The apparatus 10 contains a melt feeder 23 provided with at least one heating element 25 disposed around its outer periphery. The feeder 23 is mounted on an inclined temperature-controlled metering barrel 30 such that the liquid metal flows from the feeder 23 to barrel 30 by way of gravity through a feeder conduit or port 27. A ram or metering rod 32 is arranged coaxially with the barrel 30 and extends along the center axis of the barrel 30. The ram 32 is controlled by motor 33 for axial movement in both retracting and advancing directions along the barrel 30 to meter the amount of metal leaving barrel 30 and for rotation around its own axis if stirring of the melted metal is desired inside barrel 30. The motor 33 is mounted on the upper end of barrel 30.

The metering barrel 30 is mounted over an injection or accumulation barrel 50. The metering barrel 30 is mounted above the injection barrel 50 such that it is inclined with respect to the horizontal direction. An inlet port or conduit 37 is located between the barrels through which the metal flows between the metering barrel 30 and injection barrel 50.

The injection barrel 50 contains a plunger or piston 45 and an injection nozzle 57. The plunger 45 contains a seal, such as O-ring(s) 41, to form an air tight seal with the inner surface of the injection chamber 50. The plunger 45 is advanced in the injection chamber 50 by a motor or hydraulics (not shown) to inject the liquid or semi-solid metal from the injection chamber 50 through the nozzle 57 into a mold cavity 13 in mold 14. The apparatus 10 produces high quality injection molded parts at a low cost. The remaining elements shown in FIG. 1 are described in U.S. Pat. No. 5,983,976.

However, the present inventor has noted several problems with the apparatus 10 which increase the apparatus maintenance costs and down time. First, the liquid metal in the metering barrel 30 seeps into the motor 33, which requires increased maintenance of the motor. Second, the bolts which connect barrel 30 to barrel 50 need frequent replacement due to the stress placed on the bolts by the weight of the metering barrel.

SUMMARY OF THE INVENTION

According to one preferred aspect of the present invention, there is provided an injection molding apparatus, comprising an injection chamber located in a first plane and mounted over a base of the apparatus, a metering chamber located at least partially above the first plane, and in fluid communication with the injection chamber, a metering element located in the metering chamber, a first driving mechanism which moves the metering element, wherein the first driving mechanism is connected to the metering chamber, and a melt feeder in fluid communication with the metering chamber. A fill line of the melt feeder is located below a first opening between the metering chamber and the first driving mechanism, and/or the melt feeder is mounted to the base of the apparatus.

According to another preferred aspect of the present invention, there is provided a metal injection molding apparatus, comprising a first means for housing metal to be injected into a mold, the first means located a first plane and mounted over a base of the apparatus, a second means for housing the metal to be metered, the second means located at least partially above the first plane, a third means for metering metal into the first means, a fourth means for moving the third means, and a fifth means for melting the metal provided into the second means, such that melted metal in the fifth means is located below a first opening between the second means and the fourth means and/or the fifth means is mounted to the base of the apparatus.

According to another preferred aspect of the present invention, there is provided a metal injection molding method, comprising providing solid metal into a melt feeder, melting the solid metal into a liquid state, such that fill line of the liquid metal is below a first opening between an inclined metering chamber and a first driving mechanism, providing the liquid metal into the inclined metering chamber containing the first driving mechanism attached to an upper portion of the metering chamber, metering the metal from the metering chamber into an injection chamber located below a lower portion of the metering chamber, and injecting the metal from the injection chamber into a mold.

DETAILED DESCRIPTION OF THE PREFERRED EMBODIMENTS

The present inventor has discovered that seepage of liquid metal into driving mechanism (i.e., motor and/or hydraulics) of the metering barrel may be reduced or avoided by maintaining the fill line or level of the liquid metal in the melt feeder below the opening into driving mechanism. Since the liquid metal is maintained below the level of the opening into the driving mechanism, force of gravity prevents the liquid metal from seeping into the driving mechanism.

Furthermore, the present inventor has realized that the stress on the connector which supports the metering chamber on the injection chamber may be reduced or eliminated by mounting the melt feeder directly to the machine base rather than to the metering chamber. Thus, the machine base supports the weight of the melt feeder. Less stress is placed on the metering chamber because the machine base rather than the metering chamber bears the weight of the melt feeder.

Figure 2:
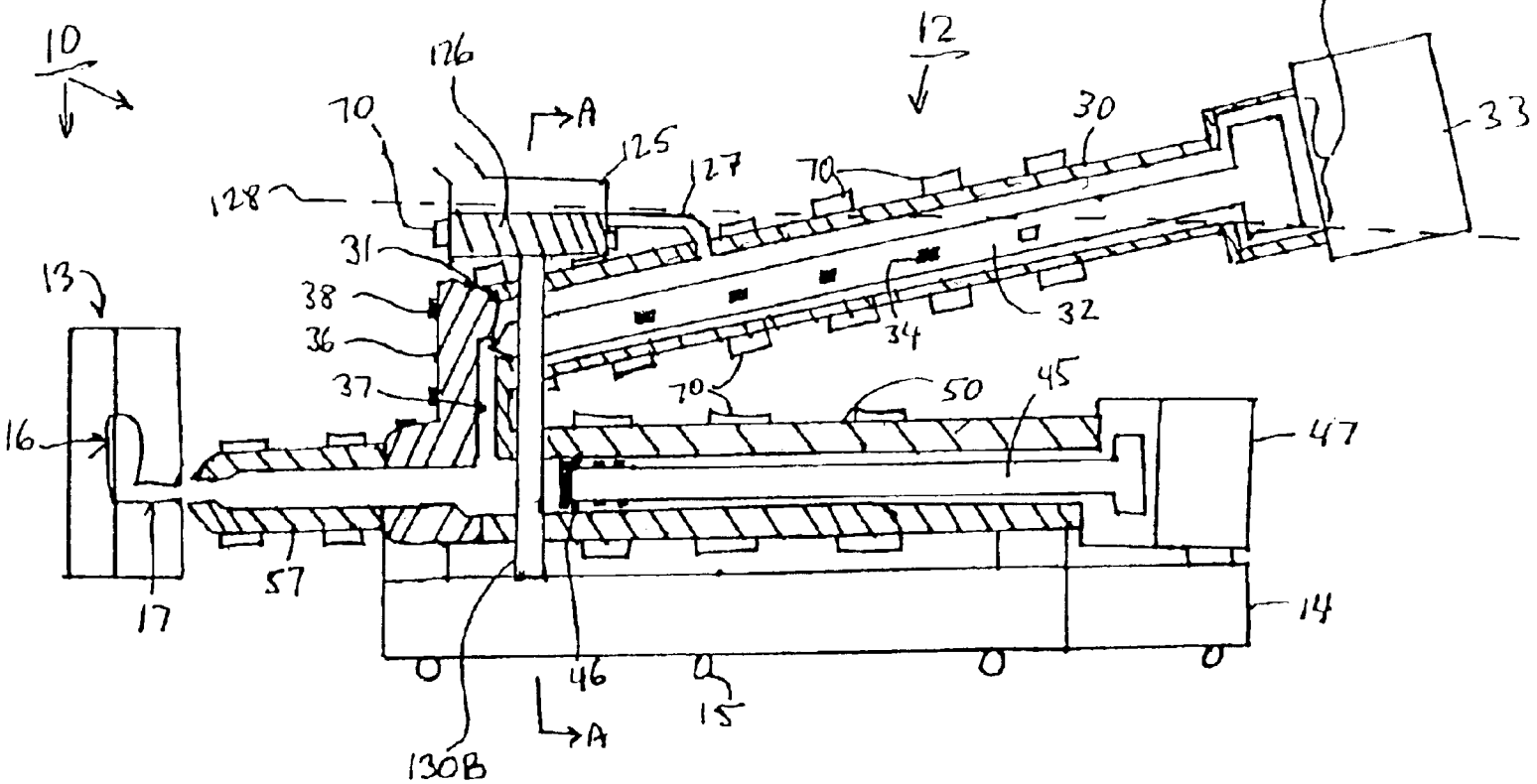
FIG. 2 is a schematic illustration of a side cross sectional view of an injection molding system according to preferred embodiments of the invention.

FIG. 2 is a schematic illustration of a side view of an injection molding system 10 according to a preferred embodiment of the invention. It should be noted that the invention is not limited to the system 10 shown in FIG. 2. Various other chamber configurations may be used and many different materials (i.e., metals, composites, plastics) may be injection molded where the liquid feed material is maintained below an opening to a driving mechanism and/or where the melt feeder is supported by the machine base. The system 10 includes an injection molding apparatus 12 and a mold 13. The apparatus 12 contains a base 14. The base 14 preferably contains the electronic components of the apparatus 12. The base 14 is preferably mounted on wheels and/or rails 15 such that it may be retracted from the mold 13 after each injection step, and advanced toward the mold 13 before each injection step by a motor or hydraulics (not shown). However, if desired, the base 14 may remain stationary during the molding process (i.e., the injection molding process operates without a sprue break). The mold 13 contains a mold cavity 16 and sprue 17.

Figure 3:
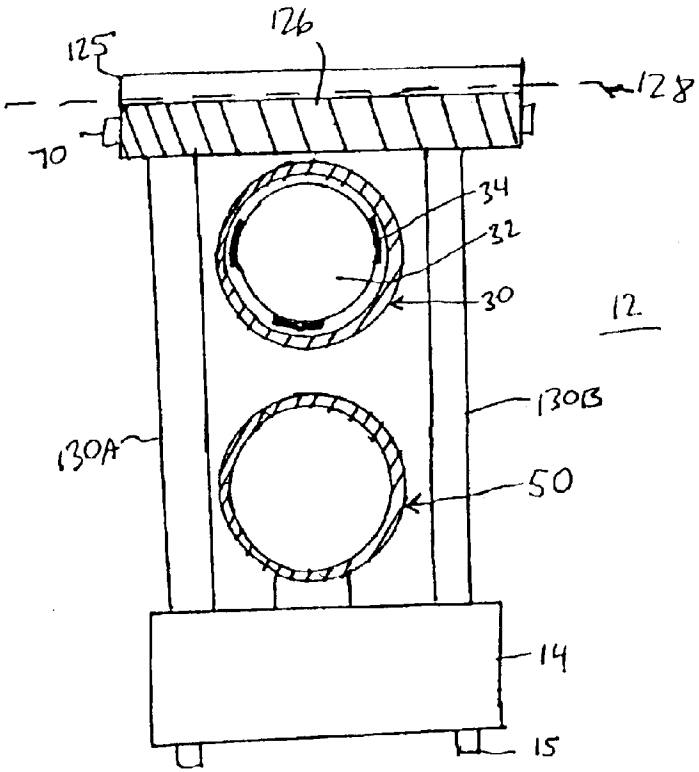
FIG. 3 is a schematic illustration of a front cross sectional view of the injection molding system along line A–A' in FIG. 2 according to preferred embodiments of the invention.

The injection molding apparatus 12 also contains a metering chamber 30 and an injection chamber 50. Preferably, each chamber 30, 50 comprises a separate cylindrical barrel, as shown in FIG. 3. However, other chamber configurations may be used if desired.

The injection chamber 50 is located in a first plane and mounted over the base 14 of the apparatus 12. Preferably, the injection chamber 50 is mounted directly onto the base 14 in a horizontal plane. However, the injection chamber 50 may be mounted in a plane other than a horizontal plane.

The metering chamber 30 is located at least partially above the first plane (i.e., above the injection chamber 50). Preferably, the metering chamber 30 is located entirely over the injection chamber 50 and inclined 5 to 60 degrees, such as 20 to 45 degrees, with respect to the horizontal direction, as shown in FIG. 2. However, the lower portion 31 of metering chamber 30 may be located adjacent to the side of the injection chamber 50, while the metering chamber 30 is inclined with respect to the horizontal direction as shown in U.S. Pat. No. 5,836,372.

The lower end 31 of the metering chamber 30 is mounted to the injection chamber 50. For example, the lower end 31 of chamber 30 may be mounted to the top of the injection chamber 50, as shown in FIG. 2. Alternatively, the lower end 31 of chamber 30 may be mounted to the side of the injection chamber 50, as shown in U.S. Pat. No. 5,836,372. Preferably, a connector 36 is used to connect chamber 30 to chamber 50. Most preferably, the connector 36 connects chambers 30 and 50 by nuts and bolts, welds, clamps and/or other connecting elements 38. A first conduit or port 37 located in connector 36 connects the interior of the metering chamber 30 to the interior of the injection chamber 50, such that the metering chamber 30 is in fluid communication with the injection chamber 50 (i.e., melted metal can pass from chamber 30 to chamber 50). Alternatively, the connector 36 may be omitted and the chambers 30 and 50 may be directly attached to each other.

A metering element 32 is located in the metering chamber 30. Preferably, the metering element 32 comprises a metering or stopper rod that is arranged coaxially within the metering chamber 30 and extends along the center axis of the chamber 30. The rod is used to meter the amount of melted metal that is provided from the metering chamber 30 into the injection chamber 50. The outer diameter of the rod 32 is smaller than the inner diameter of the chamber 30, such that melted metal flows in the space between the rod 32 and the chamber 30. The rod 32 is controlled by a driving mechanism 33. Preferably, the driving mechanism 33 is a motor, but may alternatively comprise a hydraulic system. The driving mechanism provides for axial movement of rod 32 in both retracting and advancing directions along the chamber 30, and optionally for rotation around the rod's 32 own axis if stirring of the melted metal is desired inside chamber 30. In an alternative aspect of the present invention, the metering element 32 may comprise a screw, as disclosed in U.S. Pat. No. 5,836,372, rather than a metering rod.

In the another preferred aspect of the invention, the metering rod 32 includes optional supporting ribs or fins 34, as shown in FIGS. 2 and 3. The fins 34 are preferably attached to the rod 32. Preferably, there is a small clearance between the fins 34 and the inner walls of the metering chamber 30. Alternatively, fins 34 can slide on the inner circumference of the barrel 30, both coaxially with the length of chamber 30 and/or in a circular motion about the chamber 30 axis. Alternatively, the fins 34 may be attached to the inner circumference of the barrel 30 in such a manner as to allow the bare rod 32 to slide by. The fins 34 can be made of the same material as the rod 32 or from a different material that can withstand the required process temperatures. The fins prevent the rod 32 from tilting and wobbling away from the metering chamber 30 axis during advancing and retracting motion of the rod 32. They also second enhance the uniform temperature distribution of the melted metal if the rod is rotated around its axis.

The rod 32 as shown in FIG. 2 has a pointed tip, but any shape may be used, including a blunt end or a rounded end. Preferably, the tip of rod 32 has a shape capable of blocking the first conduit 37 to prevent the flow of melted metal between the metering chamber 30 and injection chamber 50, when the rod 32 is fully advanced inside chamber 30. Thus, the metering or stopper rod 32 meters the amount of metal provided into the injection chamber by periodically sealing the conduit 37.

The injection chamber 50 contains a plunger or piston 45 and an injection nozzle 57. The plunger 45 contains a seal, such as O-ring(s) 46, to form an air tight seal with the inner surface of the injection chamber 50. This allows the plunger 45 to create a suction in the injection chamber 50 when the plunger 45 retracts. The plunger 45 is advanced in the injection chamber 50 by a second driving mechanism 47, such as a motor or hydraulics, to inject the melted metal from the injection chamber 50 through the nozzle 57 into the mold cavity 16 in mold 13. A plurality of resistance band or cartridge heaters 70 are arranged adjacent to chambers 30 and 50 and nozzle 57 to provide the desired temperature inside these chambers. Alternatively, one or more of the heaters 70 may comprise an RF heaters or another type of heater.

A melt feeder 125 is provided over a portion of the slanted metering chamber 30. At least one heating element 70 is disposed around its outer periphery. The heating element 70 operates to maintain the feeder 125 at a temperature high enough to keep the metal 126 supplied throughout the feeder 125 in a liquid state. A conduit or port 127 connects the melt feeder 125 with the interior metering chamber 30. The liquid metal enters the metering chamber 30 from feeder 125 through the conduit 127. The feeder 125 may have any desired shape, and may optionally contain a cover and an inert gas inlet, such as an Ar or $SF_6$ inlet, to protect the metal 126 from oxidation.

In a first preferred embodiment of the present invention, a fill line 128 of the melt feeder 125 is located below an opening 129 between the driving mechanism 33 and the metering chamber 30, as shown in FIG. 2. The fill line 128 is an imaginary line which indicates the uppermost allowable liquid metal 126 level in the feeder 125. Thus, the liquid metal 126 level in the feeder is always maintained below the opening 129 into the driving mechanism 33, such as a motor. The opening 129 is provided to allow the driving mechanism 33 to be connected to the metering element 32.

The liquid metal does not seep into the driving mechanism 33 because the metal 126 in the feeder 125 (and thus in the metering chamber 30) is maintained below the opening 129 into the driving mechanism 33. Since the liquid metal 126 is at its highest point in the apparatus 12 while it is in the feeder 125, the liquid metal ordinarily does not flow above the fill line 128 in any part of the apparatus 12 because it would have to flow against the force of gravity to be above the fill line 128.

Figure 1:
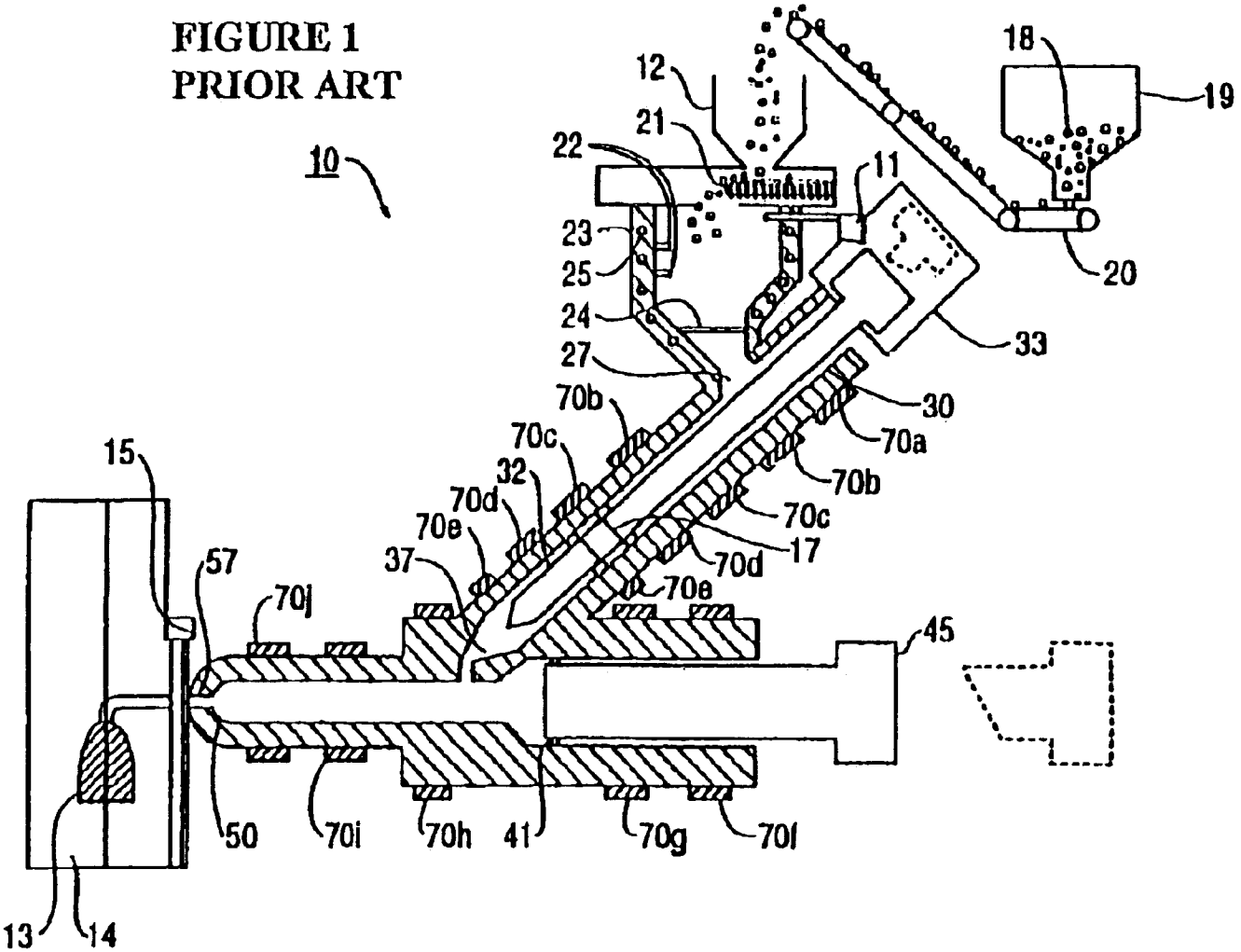
FIGURE 1 PRIOR ART
FIG. 1 is a side cross sectional view of a first prior art apparatus.

In order to maintain the level of the liquid metal 126 below the opening 129 in the feeder 125 and metering chamber 30, the location and/or dimensions of the feeder 125 may differ compared to the feeder 23 of the prior art apparatus illustrated in FIG. 1. For example, the feeder 23 is mounted over the rear or upper portion of the metering barrel in the prior art apparatus shown in FIG. 1. However, the feeder 125 of the first preferred embodiment of the present invention is preferably located over the front or lower portion 31 of the metering chamber 30. Thus, the second conduit 127 between the feeder 125 and the metering chamber 30 extends from a sidewall of the feeder 125 into a rear or upper portion of the metering chamber 30.

In another preferred aspect of the first embodiment, the width of the melt feeder 125 is greater than a height of the melt feeder, as shown in FIGS. 2 and 3. This allows more metal 126 to be stored in the feeder 125 below the fill line 128.

In an alternative aspect of the first preferred embodiment, the top of the melt feeder 125 is located below the opening 129 to the driving mechanism 33. This configuration is advantageous because it further reduces the likelihood that liquid metal 126 would seep into the driving mechanism 33. For example, large feed metal ingots may be provided into the feeder 125 and melted therein to the liquid state. Even if the large metal ingots cause the liquid metal 126 to splash upwards in the feeder 125, this would still not cause liquid metal in the metering chamber 30 to enter the opening 129 into the driving mechanism, because the entire feeder 125 is located below the opening 129.

In a second preferred aspect of the present invention, the melt feeder 125 is mounted to the base 14 of the apparatus 12. The melt feeder is mounted to the base 14 of the apparatus 12 using a least one support beam 130A, 130B. Preferably, more than one support beam is used, such as two to four beams. The beams may be any weight bearing members that bear at least 50%, preferably at least 90% of the weight of the feeder 125. The beams may have any desired shape. For example, the beams may comprise rods having a circular or polygonal cross section or the beams may comprise plates that extend along the length of the feeder.

One configuration of the beams 130A, 130B is shown in FIG. 3. A first weight bearing support beam 130A extends from the melt feeder 125 to the base 14 adjacent to a first side of the metering chamber 30 and the injection chamber 50. A second weight bearing support beam 130B extends from the melt feeder 125 to the base 14 adjacent to a second side of the metering chamber 30 and the injection chamber 50. The metering chamber 30 and the injection chamber 50 are located between the first support beam 130A and the second support beam 130B.

The configuration of the second preferred embodiment is advantageous because the base 14 bears most or all of the weight of the feeder 125 and the liquid metal 126 located in the feeder. Thus, most or all of the weight of the feeder 125 is taken off the metering chamber 30, which extends the useful life of the connector 36 and connecting elements 38 which support the metering chamber 30 over the injection chamber 50. This decreases the system down time and repair costs.

The apparatus of the second preferred embodiment may be used separately from or together with the melt feeder of the first preferred embodiment. Thus, a melt feeder 125 connected to the base 14 by beams 130A, 130B may have a fill line 128 that is located above the opening 129 into the driving mechanism 33. Alternatively, the melt feeder 125 that has a fill line 128 below the opening 129 may be supported by the metering chamber 30 rather than the base 14 However, in the third preferred embodiment of the present invention, the melt feeder of the first and second embodiments is used in combination. Thus, the melt feeder 125 fill line 128 is located below the opening 129 to the driving mechanism 33 and the melt feeder 125 is mounted to the base 14 by support beams 130A, 130B.

An injection molding method using system 10 will now be described. After injection (i.e. after a shot), the nozzle 57 is separated from the mold 13. Preferably, this is accomplished by moving the injection molding apparatus 12 away from a stationary mold 13 die. Metal feed, such as solid metal ingots or pellets are provided into the melt feeder 125. The metal feed is melted into the liquid state. The fill line 128 of the liquid metal 126 is below a first opening 129 between an inclined metering chamber 30 and a first driving mechanism 33 attached to the upper portion of chamber 30. The metal is metered from the feeder 125 into the metering chamber 30 through the upper conduit 127.

The metering rod 32 is retracted in the metering chamber 30 to allow the liquid metal to flow from chamber 30 through the lower conduit 37 into the injection chamber 50 by the force of gravity. The rod 32 may be rotated about its axis to homogenize the temperature of the metal in the metering chamber 30.

The plunger 45 which is housed in the injection chamber 50 is retracted. Preferably, during retraction the plunger 45 acts like a pharmaceutical syringe that draws in liquid from a container of liquid. Specifically, as the plunger 45 retracts, it creates a suction to draw in melted metal from the metering chamber 30 into the injection chamber 50 through the lower conduit 37.

After plunger 45 retraction is stopped, the rod 32 is advanced downward. As a result, any metal collected in a lower portion of the metering chamber 30 is pushed into the injection chamber 50 through the lower conduit 37. The rod 32 preferably advances through barrel 30 until its end closes off the inlet to conduit 37. The rod 32 preferably remains in this position to keep conduit 37 sealed off until injection is complete and the next shot cycle is started. The advanced rod 32 prevents metal and gases from flowing between the metering chamber 30 and the injection chamber 50. The plunger 45 is then advanced in the injection chamber to inject the metal into the mold cavity 16. The nozzle 57 tip may be sealed between injection cycles by a shutter, by forming semi-solid residue in the nozzle tip or by using a nozzle with an upraised or upwardly tilted tip.

Preferably, the temperatures in chambers 30 and 50 and in nozzle 57 are set sufficiently high to maintain the melted metal entirely in the liquid state from the time it exits the feeder 125 into the metering chamber 30 to the time the melted metal is injected into the mold 13 from the injection chamber 50. The temperatures may be varied depending on the type of metal part being molded. However, if it is desired to practice the method described in U.S. Pat. Nos. 5,836,372 or 6,135,196, then the metal may be maintained in the semi-solid state in chambers 30 and/or 50. The terms "melted metal" and "melted material" as used herein encompasses metals, metal alloys, plastics and other materials in a liquid or semi-solid state which can be processed in an injection molding system. It should be noted that the invention is not limited to the actual chamber layout shown in FIGS. 2 and 3. Various other injection molding apparatus chamber configurations may be used where the liquid feed material is maintained below an opening to a driving mechanism and/or where the melt feeder is supported by the machine base.

A metal part is preferably produced by injection molding a magnesium (Mg) alloy in a liquid state. The invention is not limited to processing of Mg and is equally applicable to other types of materials, such as plastics, pure metals and metal alloys. A wide range of such pure metals and alloys are potentially useful in this invention, including magnesium (Mg), Mg alloys, aluminum (Al), Al alloys, zinc (Zn), Zn alloys, composite materials (such as a metal ceramic composite) and the like.

The foregoing description of the invention has been presented for purposes of illustration and description. It is not intended to be exhaustive or to limit the invention to the precise form disclosed, and modifications and variations are possible in light of the above teachings or may be acquired from practice of the invention. The drawings and description were chosen in order to explain the principles of the invention and its practical application. It is intended that the scope of the invention be defined by the claims appended hereto, and their equivalents.

What is claimed is:

1. A metal injection molding method, comprising:

providing solid metal into a melt feeder;

melting the solid metal into a liquid state, such that a fill line of the liquid metal is below a first opening between an inclined metering chamber and a first driving mechanism;

providing the liquid metal into the inclined metering chamber containing the first driving mechanism attached to an upper portion of the metering chamber;

metering the metal from the metering chamber into an injection chamber located below a lower portion of the metering chamber; and injecting the metal from the injection chamber into a mold.

2. The method of claim 1, wherein the melt feeder is mounted to apparatus base which supports the injection chamber.

3. The method of claim 2, further comprising rotating a metering rod in the metering chamber by the first driving mechanism to homogenize a temperature of the liquid metal in the metering chamber.

4. The method of claim 2, wherein metering the metal comprises moving a metering rod in the metering chamber to prevent the metal from advancing from the metering chamber to the injection chamber during the injection step.

5. The method of claim 4, further comprising:

retracting a plunger in the injection chamber to create a suction in the injection chamber to assist in drawing the metal from the metering chamber into the injection chamber; and advancing the plunger to inject the metal into the mold.

6. The method of claim 1, wherein the metal comprises an aluminum or magnesium alloy.

* * * * *